US005740559A

United States Patent [19]

Thiel

[11] Patent Number: 5,740,559

[45] Date of Patent: Apr. 21, 1998

[54] FOOTWEAR ACCESSORY FOR USE WITH A SHOE TO SIMULATE THE APPEARANCE OF A BOOT

[76] Inventor: Ingeborg Thiel, 1435 Bedford St. 3P, Stamford, Conn. 06905

[21] Appl. No.: 749,541

[22] Filed: Nov. 15, 1996

Related U.S. Application Data

[60] Provisional application No. 60/022,359, Jul. 24, 1996.

[51] Int. Cl. [6] ..... A41B 11/00

[52] U.S. Cl. ..... 2/239; 36/1; 36/1.5; 36/2 R; 36/9 R

[58] Field of Search ..... 2/239, 409, 22, 2/242, 61; 36/1, 1.5, 2 R, 9 R, 10, 36 R

[56] References Cited

U.S. PATENT DOCUMENTS

| | | | |
|---|---|---|---|
| 343,460 | 6/1886 | Kimball | 36/9 R |
| 371,746 | 10/1887 | Fargo | 36/9 R |
| 452,158 | 5/1891 | Beiger et al. | 36/9 R |
| 602,407 | 4/1898 | Roos | 36/9 R |
| 870,037 | 11/1907 | Kline | 36/9 R |
| 883,573 | 3/1908 | Savage | 36/9 R |
| 993,203 | 5/1911 | Savage | 36/9 R |
| 1,319,680 | 10/1919 | Lieben | 36/9 R |

*Primary Examiner*—Gloria M. Hale
*Attorney, Agent, or Firm*—Thomas A. Gallagher

[57] ABSTRACT

A footwear accessory for use with a shoe includes a stocking-like structure having a lower foot portion and an upper ankle portion wherein the lower foot portion is made of a porous hosiery material and the upper ankle portion is made of a material which simulates a boot leg. According to a presently preferred embodiment of the invention, the upper ankle portion is made of a stretchable material, may have a glossy or non-glossy appearance, may be a solid color or a print, may be provided with different textures and may include a functional closure device such as a zipper or a number of buttons or clasps. The dimensions of the upper and lower portions of the footwear accessory according to the invention are preferably chosen so that the lower foot portion is completely concealed by a shoe. The dimensions of the upper ankle portion may vary to cover any length of leg desired. One presently preferred embodiment has an upper ankle portion which terminates slightly below the knee. Another presently preferred embodiment has an upper portion which terminates above the knee at a mid-portion of the thigh.

20 Claims, 4 Drawing Sheets

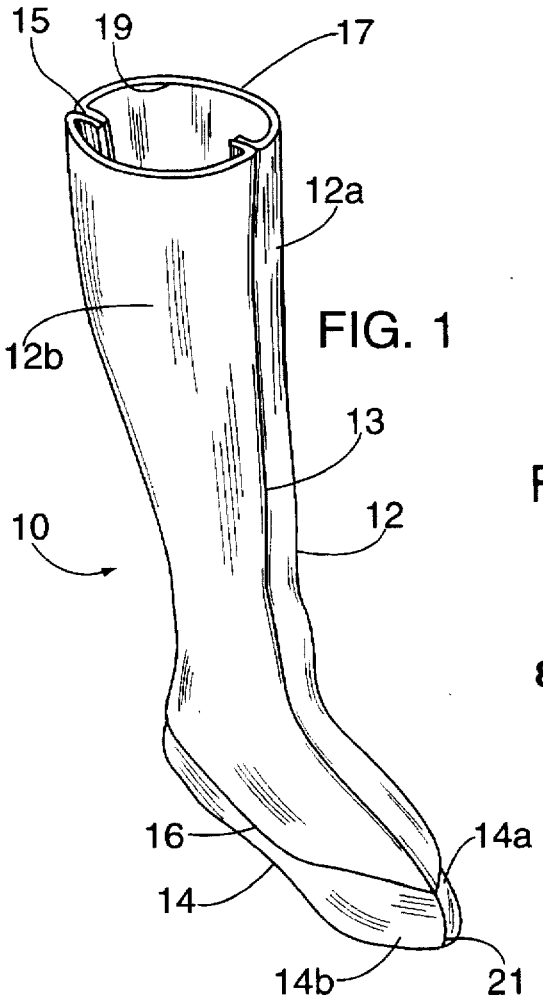
FIG. 1
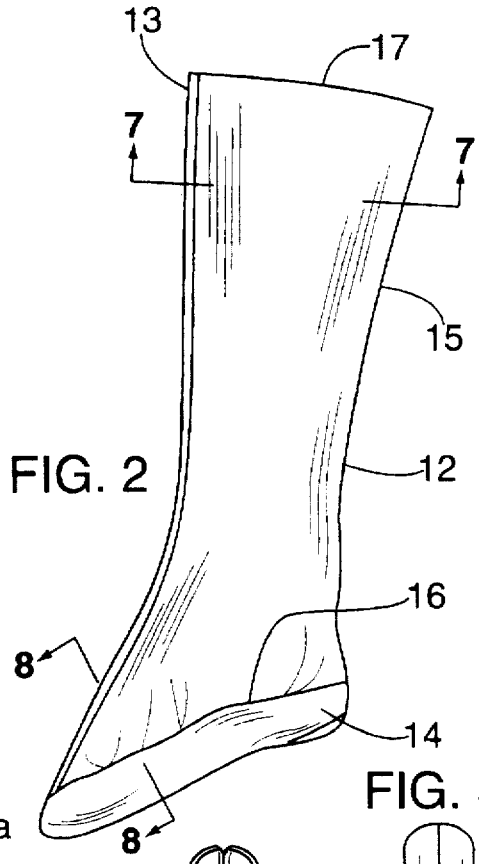
FIG. 2
FIG. 3
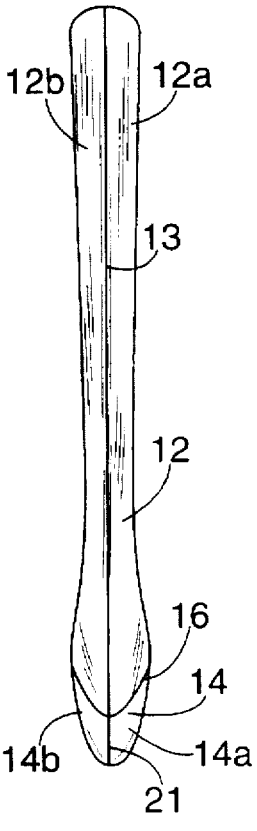
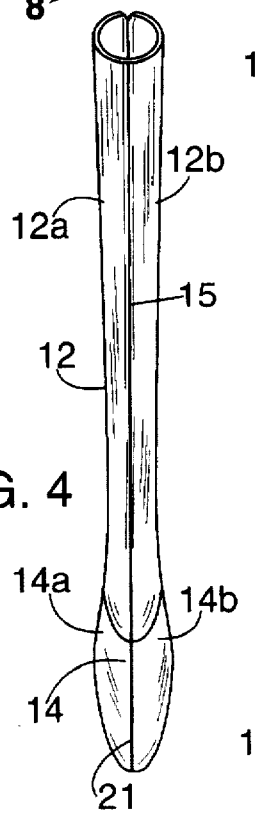
FIG. 4
FIG. 5
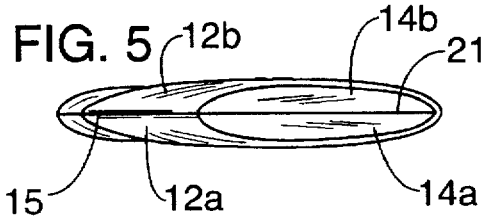
FIG. 6
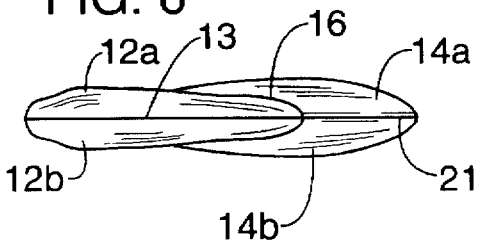

FOOTWEAR ACCESSORY FOR USE WITH A SHOE TO SIMULATE THE APPEARANCE OF A BOOT

This application claims the benefit of provisional application Ser. No. 60/022,359 filed Jul. 24, 1996, entitled "Stockinged Boot", the complete disclosure of which is hereby incorporated herein by reference.

BACKGROUND OF THE INVENTION

1. Field of the Invention

The invention relates to a footwear accessory. More particularly, the invention relates to a stocking-like structure which has boot leg portion and a foot portion and which, when worn with a shoe, simulates the appearance of a boot.

2. State of the Art

There are various known footwear accessories which are used together with shoes to create a fashionable appearance. These known accessories are generally different types of hosiery, ankle warmers, and the like. While these accessories may make an interesting "fashion statement", they do not generally change the appearance of the shoes with which they are used.

Fashionable boots are also well known and are made of a variety of materials, both natural and synthetic. Boots are made in a variety of sizes and generally cover at least part of the wearer's ankle and may extend up to and over the wearer's knee. Whereas different types of hosiery can be used with shoes to create different fashion statements, boots are not so adaptable since they most often conceal hosiery. Thus, the fashionable appearance of boots is generally static and not susceptible to design modification by the wearer. In addition, boots are often difficult to don and uncomfortable to wear, especially for extended periods. Nevertheless, boots remain a popular fashion footwear.

SUMMARY OF THE INVENTION

It is therefore an object of the invention to provide a footwear accessory which gives the fashionable appearance of a boot, but which is more versatile and adaptable than a boot.

It is also an object of the invention to provide a footwear accessory which is usable together with a shoe to create a unique fashionable appearance.

It is another object of the invention to provide a footwear accessory which is usable with or without hosiery.

It is still another object of the invention to provide a footwear accessory which is easy to don and comfortable to wear.

Yet another object of the invention is to provide a footwear accessory which is inexpensive to manufacture and thus may be provided in a variety of styles and colors.

In accord with these objects which will be discussed in detail below, the footwear accessory of the present invention includes a stocking-like structure having a lower foot portion and an upper ankle portion wherein the lower foot portion is made of a porous hosiery material such as NYLON or cotton and the upper ankle portion is made of a material which simulates a boot leg. According to a presently preferred embodiment of the invention, the upper ankle portion is made of a stretchable material, may have a glossy or non-glossy appearance, may be a solid color or a print, may be provided with different textures and may include a functional closure device such as a zipper or a number of buttons or clasps. The dimensions of the upper and lower portions of the footwear accessory according to the invention are preferably chosen so that the lower foot portion is completely concealed by a shoe. The dimensions of the upper ankle portion may vary to cover any length of leg desired. Two presently preferred embodiments have an upper ankle portion which terminate slightly below the knee and an upper ankle portion which terminates above the knee to a mid-portion of the thigh, respectively.

The footwear accessory according to the invention may be made of a material and a color which matches a shoe with which it is to be used. Alternatively, the footwear accessory according to the invention may be made of a material and a color which complements a shoe with which it is to be used.

Advantages of the invention include the fact that the invention is relatively inexpensive to manufacture. Users of the invention may therefore obtain several different styles of the invention thereby broadening the fashionability of their footwear wardrobe without undue expense. Additionally, it is an advantage of the invention that it is relatively easy to don compared to a conventional boot. The porous lower foot portion of the invention renders it very comfortable to wear. Further, the fact that the invention is used in conjunction with shoes allows the user to remove shoes without removing the invention.

Additional objects and advantages of the invention will become apparent to those skilled in the art upon reference to the detailed description taken in conjunction with the provided figures.

BRIEF DESCRIPTION OF THE DRAWINGS

FIG. 1 is a perspective view of a first embodiment of a footwear accessory according to the invention;

FIG. 2 is a side elevational view of the first embodiment of the invention;

FIG. 3 is a front elevational view of the first embodiment of the invention;

FIG. 4 is a rear elevational view of the first embodiment of the invention;

FIG. 5 is a bottom view of the first embodiment of the invention;

FIG. 6 is a top view of the first embodiment of the invention;

DETAILED DESCRIPTION OF THE PREFERRED EMBODIMENTS

Figure 7:
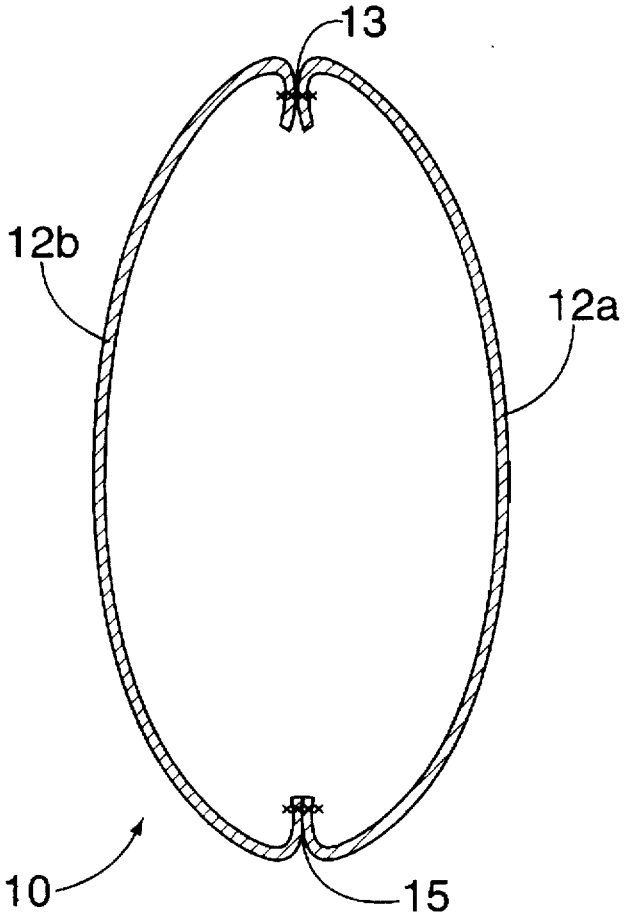
FIG. 7 is a sectional view taken along line 7—7 of FIG. 2.
Figure 8:
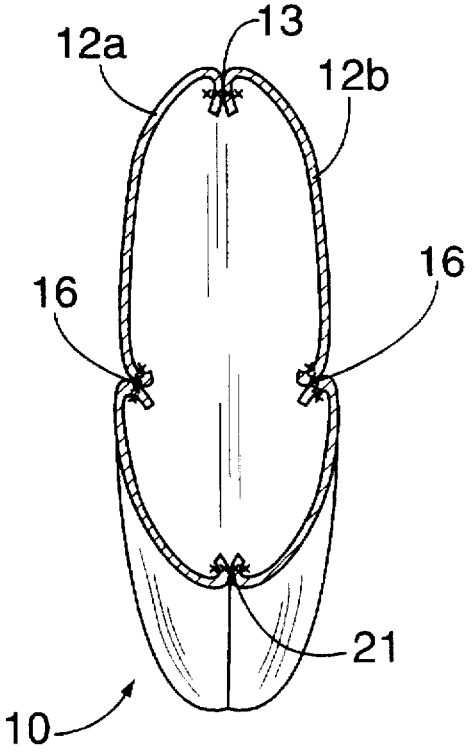
FIG. 8 is a sectional view taken along line 8—8 of FIG. 2.

Referring now to FIGS. 1 through 8, a first embodiment of a footwear accessory 10 according to the invention includes an upper portion 12 and a lower portion 14 which are coupled to each other at a seam 16. The upper portion 12 is dimensioned to cover the wearer's ankle and calf as well as an upper portion of the foot. The upper most edge 17 of the upper portion 12, according to this embodiment, terminates below the wearer's knee. The lower portion 14 is dimensioned to cover the sides and lower portion of the foot as well as the toes of the wearer. As mentioned above, the upper portion 12 is made of a material which simulates a boot leg and the lower portion 14 is made of a porous hosiery material. According to a presently preferred embodiment, the upper portion 12 is made of a material which is somewhat elastic in order to support the upper portion around the wearer's leg. Optionally, an elastic portion 19 may be attached to the upper edge 17 of the upper portion 12 in order to provide vertical support for the upper portion 12.

As shown in FIGS. 1–8, the first embodiment of the footwear accessory 10 is advantageously manufactured from four pieces which are cut according to a pattern. For example, the upper portion 12 is formed from two pieces 12*a* and 12*b* which are coupled to each other at seams 13, 15. Similarly, the lower portion 14 is formed from two pieces 14*a*, 14*b* which are coupled to each other at seam 21. It will be appreciated, however, that the footwear accessory 10 according to the invention may be made from more or fewer pieces depending on economic and aesthetic considerations. For example, the lower portion 14 can be made from a single piece of nylon or knit fabric. Moreover, the upper portion 12 may be made from many pieces as a quilt work. In any event, the locations of the seams 13, 15, and 21 are chosen mainly for aesthetic purposes which may be unnecessary to the invention. The seam 16, however, is preferably located so that all of the lower portion 14 is concealed inside a shoe to thereby give the appearance of a boot.

As mentioned above, the inventive footwear accessory may be made from a variety of materials in order to provide a variety of fashionable looks. In accord with the invention, however, the lower portion 14 should be made from a porous breathable material commonly used in hosiery. The upper portion 12, on the other hand, may be made from materials such as vinyl, suede, leather, canvas or composite materials. It is preferable, that the upper portion 12 be provided with sufficient elasticity and/or rigidity in order that it remain vertically oriented, i.e. stay up around the wearer's leg while worn. However, the upper portion may be constructed to assume a somewhat "floppy" appearance and need not hug the leg closely. In either case, the material may have a smooth surface or a textured surface. It may have a wrinkle design and may be foldable and/or drapable.

From the foregoing those skilled in the art will appreciate that the basic concept of the invention may be modified in many ways. For example, the initial concept of the invention is to provide an accessory which matches the style and color of a shoe and which when used with a shoe simulates a boot. However, it will be understood that a footwear accessory according to the invention need not match a shoe in color or material. Indeed, material which is complementary in style or color to the shoe material may be desirable to create a particular fashionable look. In addition, a multicolor footwear accessory is within the scope of the invention.

Figure 9:
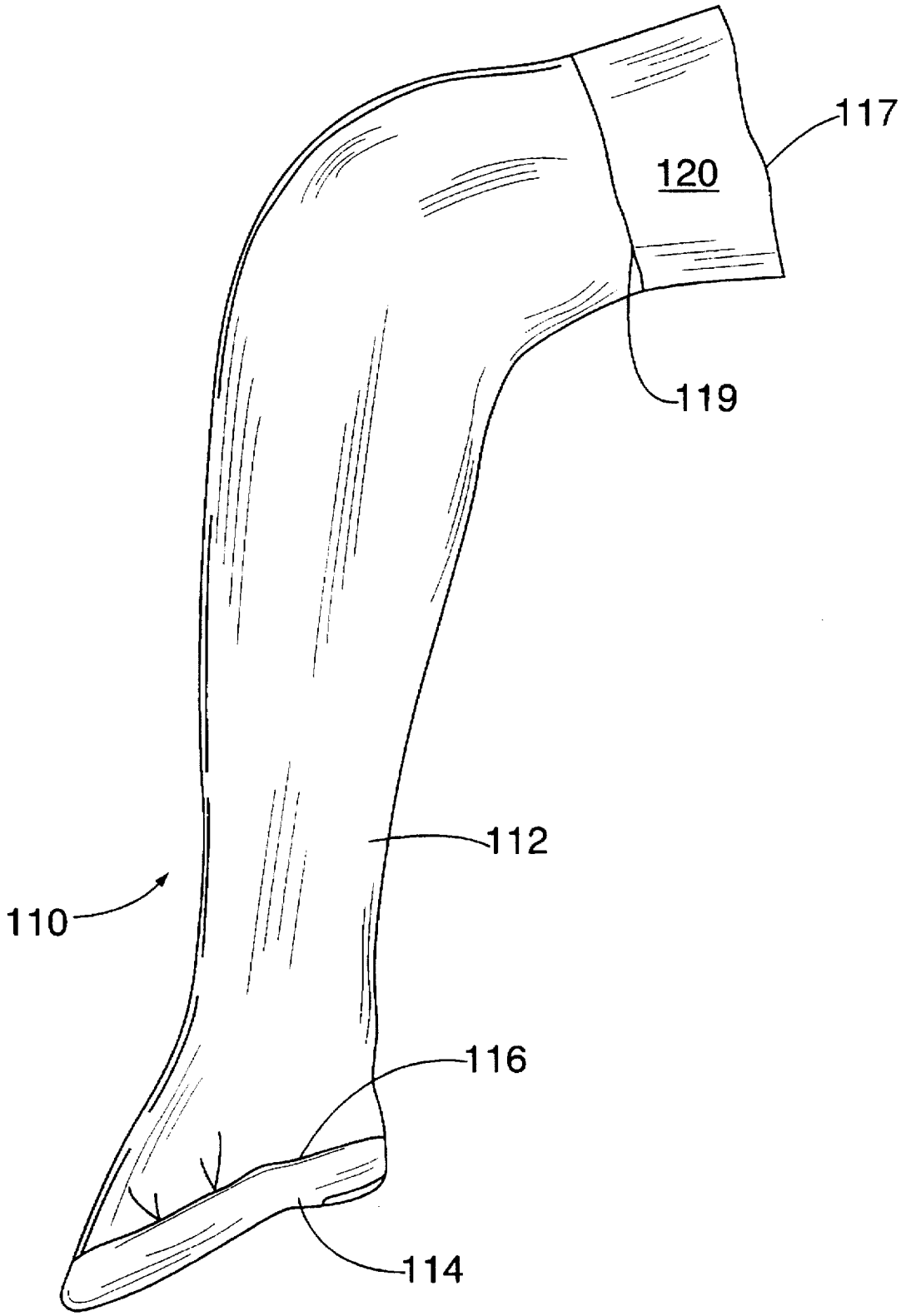
FIG. 9 is a view similar to FIG. 2 of a second embodiment of the invention which extends over the wearer's knee and has an upper cuff.

Turning now to FIG. 9, a second embodiment of a footwear accessory 110 according to the invention is similar to the embodiment 10 described above with similar reference numerals referring to similar parts. In this embodiment, however, the upper portion 112 is dimensioned to extend up and over the knee of the wearer. In addition, the upper edge 117 is folded to form a cuff 119. The upper portion 112 may also be provided with an inner lining 120 which is partially visible in the cuff area.

Figure 10:
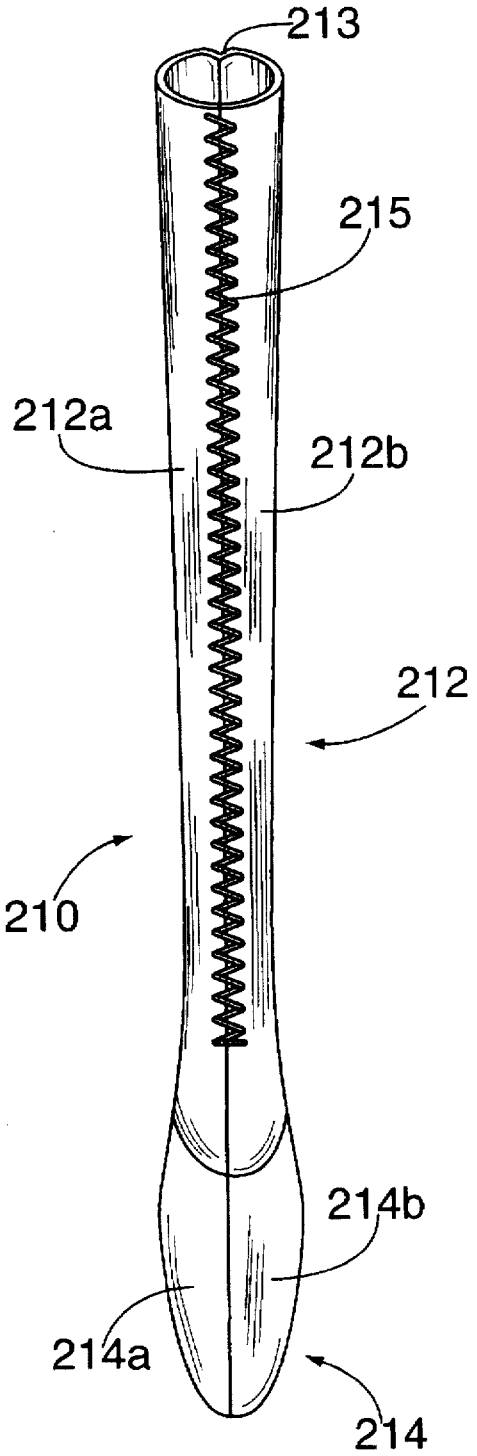
FIG. 10 is a view similar to FIG. 4 of a third embodiment of the invention incorporating laces.

Still another embodiment of the invention is shown in FIG. 10. The footwear accessory 210 shown in FIG. 10 is similar to the embodiment 10 described above with similar reference numerals referring to similar parts. In this embodiment, however, the rear seam 215 which joins the parts 212*a* and 212*b* of the upper portion 212 is formed as a plurality of laces.

Figure 11:
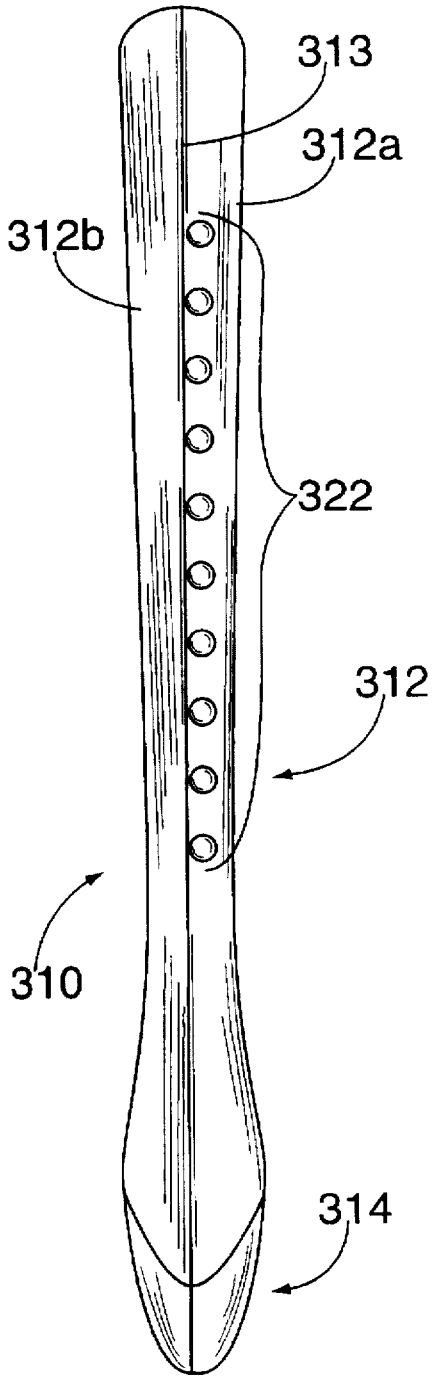
FIG. 11 is a view similar to FIG. 10 of a fourth embodiment of the invention incorporating buttons.

Still another embodiment of the invention is shown in FIG. 11. The footwear accessory 310 shown in FIG. 11 is similar to the embodiment 10 described above with similar reference numerals referring to similar parts. In this embodiment, however, a plurality of buttons 322 are arranged adjacent tot he from seam 313. The buttons may be merely decorative or may actually from a closure between the parts 312*a*, 312*b* of the upper portion.

There have been described and illustrated herein several embodiments of a footwear accessory which, when used in conjunction with a shoe, simulates a boot. While particular embodiments of the invention have been described, it is not intended that the invention be limited thereto, as it is intended that the invention be as broad in scope as the art will allow and that the specification be read likewise. Thus, while particular materials have been disclosed, it will be appreciated that other materials could be utilized. Also, while a particular number of pieces have been shown, it will be recognized that other numbers of pieces could be used with similar results obtained. Moreover, while particular configurations have been disclosed in reference to laces, buttons, and cuffs, it will be appreciated that other configurations could be used as well and the upper portion of the footwear accessory may be decorated with other ornamental attachments such as lace, tassels, sequins, buckles, zippers, etc. Furthermore, while the invention has been disclosed as having an upper portion which extends to a point just below or just above the wearer's knee, it will be understood that different lengths can achieve the same or similar function as disclosed herein. It will therefore be appreciated by those skilled in the art that yet other modifications could be made to the provided invention without deviating from its spirit and scope as so claimed.

We claim:

1. A footwear accessory for use with a shoe, comprising:

a) an upper portion made of a first boot material which is dimensioned to cover an instep, an ankle and a portion of a leg; and b) a lower portion made of a second material which is dimensioned to cover at least a portion of a foot, said upper portion and said lower portion being coupled to each other to form a stocking structure and said lower portion being dimensioned to be substantially concealed by a pump shoe worn over said lower portion, wherein said upper portion is made of a first boot material thereby simulating a boot leg.

2. A footwear accessory according to claim 1, wherein:

said lower portion is made of a substantially porous material.

3. A footwear accessory according to claim 1, wherein:

said upper portion is dimensioned to cover an ankle and a calf, terminating at a point below a knee.

4. A footwear accessory according to claim 1, wherein:

said upper portion is dimensioned to cover an ankle, a calf, and a knee terminating at a point above the knee.

5. A footwear accessory according to claim 1, wherein:

said upper portion is made from a boot material selected from the group consisting of vinyl, suede, leather, imitation suede, and imitation leather.

6. A footwear accessory according to claim 1, wherein:

said lower portion is made from a material selected from the group consisting of cotton, nylon, and SPANDEX.

7. A footwear accessory according to claim 1, wherein:

said upper portion has at least one seam.

8. A footwear accessory according to claim 1, wherein:

said upper portion includes laces.

9. A footwear accessory according to claim 1, wherein:

said upper portion includes a plurality of buttons.

10. A footwear accessory according to claim 1, wherein:

said upper portion includes a cuff at an upper end thereof.

11. A footwear accessory, comprising:

a) an upper flexible elastic leg portion made of a first boot material thereby simulating a boot leg and sized to fit snugly around a leg; and b) a porous stretchable foot portion made of a second material attached to a lower end of said upper leg portion and sized to fit snugly around a foot.

12. A footwear accessory according to claim 11, wherein:

said foot portion is dimensioned to be substantially completely concealed by a pump shoe worn over said footwear accessory.

13. A footwear accessory according to claim 11, wherein:

said upper leg portion has sufficient rigidity to remain around a leg when worn.

14. A footwear accessory according to claim 11, wherein:

said upper leg portion has sufficient elasticity to remain around a leg when worn.

15. A footwear accessory according to claim 11, wherein:

said upper leg portion is made from two pieces which are coupled to each other by a first seam and one of a second seam, a zipper, and a plurality of buttons.

16. A footwear accessory according to claim 11, wherein:

said upper leg portion includes one of laces and a plurality of buttons.

17. A footwear accessory for use with a shoe, comprising:

a) a lower portion which is dimensioned to cover at least a portion of a foot; and b) an upper portion which is dimensioned to cover an instep, an ankle and a portion of a leg, said upper portion being made of a boot material thereby simulating a boot leg, said upper portion being made of a first material and said lower portion being made of a second material.

18. A footwear accessory according to claim 17, wherein:

said lower portion is made of a substantially porous material.

19. A footwear accessory according to claim 17, wherein:

said upper portion includes one of laces and a plurality of buttons.

20. A footwear accessory according to claim 17, wherein:

said upper portion includes a cuff.

* * * * *